United States Patent [19]

Fahey

[11] Patent Number: 4,783,068

[45] Date of Patent: Nov. 8, 1988

[54] APPARATUS FOR ENHANCING VERTICAL JUMP CAPABILITY

[76] Inventor: Jaime Fahey, P.O. Box 635, 25 Edgewater Dr., Matawan, N.J. 07747

[21] Appl. No.: 99,016

[22] Filed: Sep. 21, 1987

[51] Int. Cl.[4] ..... A63B 21/00

[52] U.S. Cl. ..... 272/144; 272/130

[58] Field of Search ..... 272/130, 134, 144, 145, 272/93, 138; 297/345, 347, 468

[56] References Cited

U.S. PATENT DOCUMENTS

| | | | |
|---|---|---|---|
| 4,241,913 | 12/1980 | Zwayer et al. | 272/134 |
| 4,371,162 | 2/1983 | Hartzell | 272/134 |
| 4,549,734 | 10/1985 | Hibler, Jr. et al. | 272/134 |
| 4,589,658 | 5/1986 | Gibson | 272/134 |
| 4,626,018 | 12/1986 | Massey | 297/345 |

FOREIGN PATENT DOCUMENTS

| | | | |
|---|---|---|---|
| 1258447 | 9/1986 | U.S.S.R. | 272/134 |

OTHER PUBLICATIONS

The Jumper, Coach and Athlete, 3–1981, p. 31.

*Primary Examiner*—V. Millin
*Assistant Examiner*—J. Welsh

[57] ABSTRACT

The apparatus of the invention incorporates a seat extending from a hydraulic piston support therefor, and in which the hydraulic piston is arranged to move upwardly in response to the force generated by a "strapped-in" user in attempting to raise up from the seat.

8 Claims, 2 Drawing Sheets

APPARATUS FOR ENHANCING VERTICAL JUMP CAPABILITY

FIELD OF THE INVENTION

This invention relates to exercise apparatus, in general, and to such apparatus for enhanding vertical jump movements, in particular.

BACKGROUND OF THE INVENTION

As is well known and understood, leg strength and stability are important factors in enhancing one's jumping abilities—especially as are employed in the Ballet, as well as in such sporting events as basketball, volleyball, track (e.g., the long jump, the high jump, the triple jump, etc.), as well as in cheerleading. As is also well known and understood, various equipments and apparatus have been designed over the years to enable a person to exercise, train and develop those muscles and ligaments as would enable the person to improve his or her performance in that athletic (or generally, physical) activity aside from being on the actual playing field of endeavor, itself. Weight training machines have gotten the most attention over the years—as education and specialized knowledge have developed as to the needs for proper conditioning to ever improve physical performance. Typical—and, perhaps the most widely known—of these devices are the Nautilus-type machines in which various weights and configurations are utilized in enhancing muscular strength. However, little if any attention has been given to developing apparatus that can be employed to exercise leg muscles for vertical jump activities.

As will be appreciated, those apparatus that have been developed over the recent past have usually been of a combination design, wherein different sets of muscles are, of necessity, exercised, hardened and/or stretched at the same time, simultaneously. Thus, with the weight-training devices, for example, not only are a user's shoulder muscles strengthened through a lifting activity, but leg muscles, of necessity, are strengthened simultaneously in these "snatch", "lift" and "press" activities. With rowing machines, similarly, leg, upper chest, arm and back muscles are also involved in a singular activity. On the other hand, where enhanced vertical-jump activities are to be dealt with, it could be a detriment if other parts of the body were worked upon simultaneously with the strengthening of appropriate leg muscles—certainly, for example, a ballerina with a shoulder and back musculature would not fit the desired mold—nor would a high jumper, for example, desired broad, thick chest or arm musculature where every additional millimeter of body increases the changes of dislodging the bar attempted to be cleared.

In accordance with the present invention, therefore, it would be desirable to provide, first of all, apparatus whose primary purpose is to enable a user to enhance his, or her, vertical jump prowess. It is another objective to provide such apparatus which concerns itself with the unique strengthening of the muscles and ligaments in question, without significantly affecting other parts of the human skeletal structure. As with training for such events as cheerleading, long jump, and ballet—which are typically practiced alone, and on an individual basis—it is yet another objective to provide apparatus to carry out these goals, in an uncomplicated manner, using a few moving parts as is possible, and which can be utilized in a home environment. As will most obviously be understood, it is another objective of the invention to provide such apparatus which can enhance the leg muscle and ligament strength at a controlled rate, set by the user in training, and additionally restricting the possibility of experiencing ballistic movement during the exercise range of motion.

SUMMARY OF THE INVENTION

As will become clear from the description that follows, the apparatus of the present invention incorporates a seat in which a user is strapped. The said seat has a hydraulic cylinder inherently, and rigidly connected there-beneath its bottom surface, which affords extension and additional connection at its other end to a platform where said strapped in user rests his feet. As will also be seen, the hydraulic cylinder piston can only be moved upwardly into its compressible fluid under a lifting action from atop the chair seat, which follows from an attempt of the user to stand. As such action necessitates a downward force upon the user's leg muscles, which is translated to his feet, a resistance continues to be applied to the platform until there exists sufficient downward force, as to physically raise the seat, and its inherently connected hydraulic piston, whereby creating and facilitating the process of fluid compression within the cylinders casing. By utilizing an angular platform and having the seat at a controllable angulation from the platform, in one embodiment of the invention, or by optionally utilizing a horizontal platform with a "Clevis" mount cylinder, in a second embodiment of the invention, the user can start off, in essence, from different squatting positions, and be only able to exert a force on his, or her, leg or ligament musculatures in trying to raise-up. As will be appreciated by those skilled in the art, the ease of lifting with the seat depends upon the speed and force of the leg actions, and on the resistance afforded by the fluid compression—all of which can be controllable, and, hopefully, with the strengthening leg muscles developed over periods of training and usage. Analysis is shown that such actions increase the leg muscles in such a manner, as to enhance the ability of the user to jump higher, and further, and more easily.

BRIEF DESCRIPTION OF THE DRAWINGS

These and other features of the invention will be more clearly understood from a consideration of the following description, taken in connection with the accompanying drawing, in which.

DETAILED DESCRIPTION OF THE DRAWINGS

Figure 1:
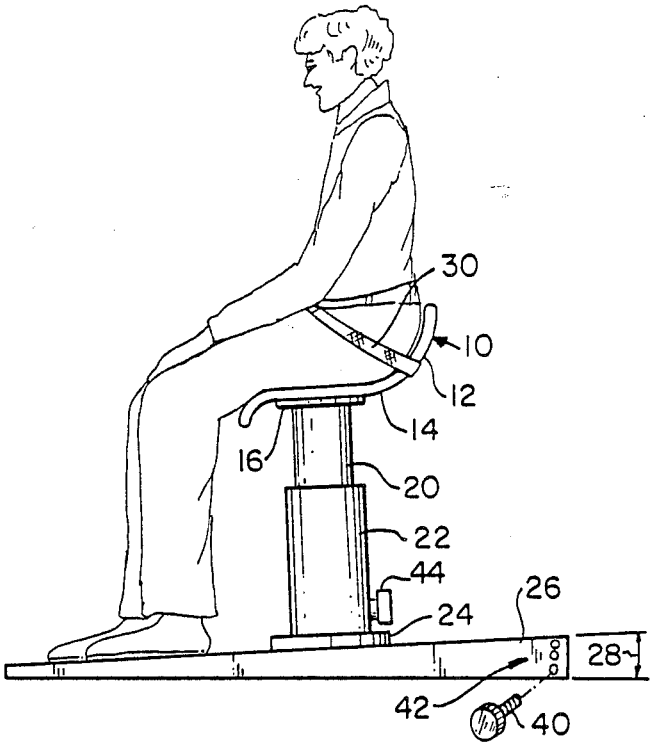
FIG. 1 is an illustration showing how the apparatus of the present invention is to be utilized.
Figure 2:
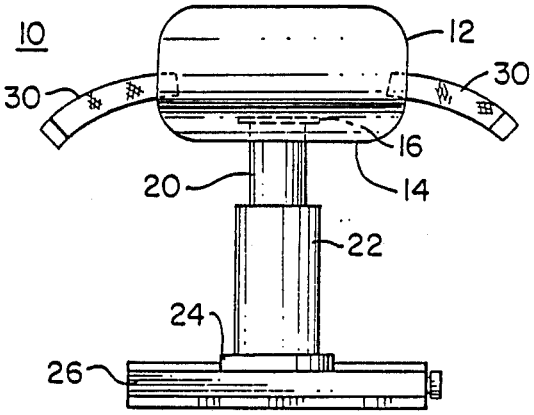
FIG. 2 is a front view showing the chair-apparatus according to a first embodiment of the invention.

Referring to FIGS. 1 and 2 of the drawings, it will be appreciated that the apparatus of the present invention incorporates a chair 10, having a back portion 12, and a seat portion 14 which is secured at an underside to a plate 16 emanating from a cylindrical rod 20 movable within a cylindrical casing 22. Such casing 22 is, in turn, secured by a second plate 24 to the top of a platform 26, of a slight angle 28 (typically in the range 20°-30°)

according to one embodiment of the invention. As will be seen, a pair of straps 30 or similar such constraint is incorporated as part of the chair 10, to secure a user in position when training with the apparatus.

In carrying out the principles of the invention, it is to be understood that in quiescent, initial condition, the cylindrical rod 20 is positioned within the casing 22, and is of a nature that it resists attempts to pull it outwardly, and upwardly, from the casing, itself. In accordance with the use of the invention, a user, strapped into position, attempts to raise the seat upwardly, against the force tending to hold the rod 20 inwardly of the casing. As will be understood, such raising is intended to be without the use of the hands—and in operation, it is intended that the hands not be employed in trying to lift the seat upwardly. To the contrary, the seat is intended to be moved upwardly through the action of the user attempting to stand by imparting a force downwardly through an attempt at straightening the legs. As will be evident, only through a force translation through the legs to the platform 26 can there be an attempt to raise the chair 10, and the amount of force needed will be seen to increase as the angle 28 is increased. Through continuing activity to try to rise, leg muscles are enhanced, acting to produce a forcex against the resistive force of the cylinder opposing the raising of the chair affixed thereto, an increasing amount of force becoming necessary as the platform angle 28 raises, in like fashion. To such end, a bolt-and-eye arrangement could be used, wherein a bolt 40 can be inserted at diferent aperture locations 42 within the platform 26 in adjusting the angle of the plane so formed in any appropriate manner. As would also be apparent, more intense results can be obtained, while continuously trying to increase the amount of leg strength through training by adjusting the elevation of the chair, from the platform 26, to a lower degree, not withstanding the "additional" adjustment of the fluid resistance control valve 44 in FIG. 1, which affords isokinetic type resistance during application of muscular force thereagainst.

Figure 3:
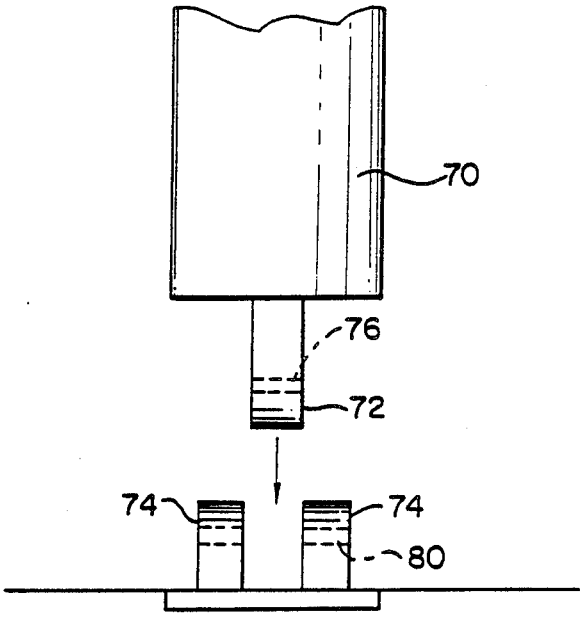
FIGS. 3 and 4 are sectional views helpful in an understanding of a second embodiment of the apparatus of the invention.
Figure 4:
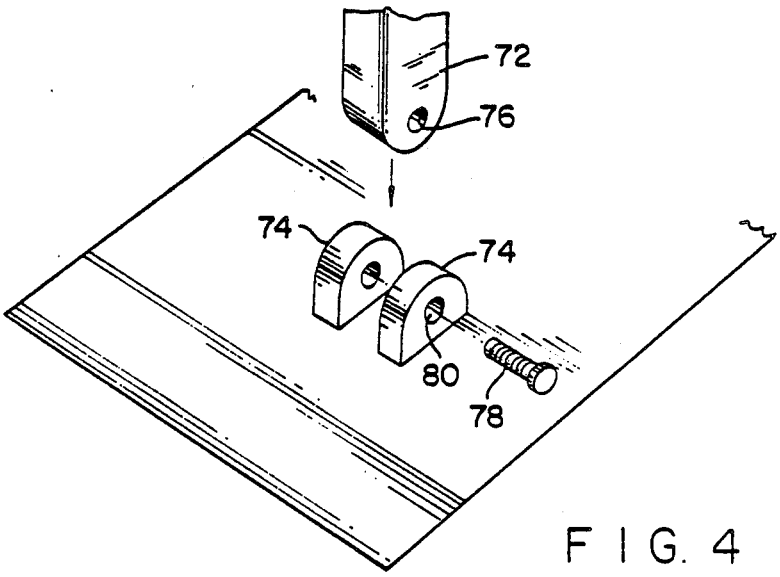

In the embodiment of the invention of FIGS. 3 and 4, on the other hand, the platform supporting the seat portion 14 is horizontal and a "Clevis" mount cylinder 70 is employed, rotatable to orient the axis of the cylinder 70 at any desire angle, and not necessarily perpendicular. The extend 72 of the cylinder 70 is dimensioned to fit between a pair of mounts 74, and is provided with an aperture 76 to receive a fastener 78 which is inserted co-linearly through aligning apertures 80 within the mounts 74. The cylinder 70 is thus able to be angularly rotated, carrying the seat portion 74 along with it, in adjusting the angulation which the user is to overcome in trying to rise. With either embodiment, by freeing the hands from the activity, it will be apparent that only leg muscles are being used to pull a user and the chair upwardly from the cylindrical casing 22. In starting from the original position, the activity strengthens exactly those same muscles which are employed in jumping activities—whether they be the aginus, antaginus, extensor or other muscles of the leg.

While there has been described what is considered to be a preferred embodiment of the present invention, it will be readily apparent to those skilled in the art that modifications can be made without departing from the scope of the teachings herein. Thus, it will be noted that the exercising afforded could also be carried out by employing the totally horizontal platform of the second embodiment, and by varying the angle that the rod 20 and casing 22 form with the platform in any appropriate manner—essentially thrusting the user more-and-more in a forwardly lifting, seated position from which he or she then tries to rise. Or, instead of adjusting the angle of the inclined platform 26, the apparatus could incorporate a lower plate 24 which, though in one configuration could sit flush against the top of the platform 26, could fit within any number of spaced grooves along such top surface in other versions, in varying the angle formed between the seat portion 14 and the top surface of the platform. Both these additional alternatives, it will be seen, could also be employed to carry out the invention as described, varying the angle so formed between the seat portion 12 and the top surface of the platform 26, quiescently at a 90° position. And, in either respect, it will be fully appreciated that the described apparatus is equally adaptable for use in training to improve "longitudinal" jumpings as well as "vertical" jumpings, and the term "vertical jump capability" is intended to encompass both types of trainings.

For at least such reasons, therefore, resort should be had to the claims appended hereto for a true understanding of the scope of the invention.

I claim:

1. Apparatus for enhancing vertical jump capability, comprising:

a platform;

a chair incorporating securing means for controllably constraining a user to be seated therein;

and means for connecting said chair to said platform, with said means including connecting and resistance means being upwardly movable in a direction from said platform towards said chair under the force of a user attempting to stand from a seated position, said resistance means including an adjustable control inorder to vary the amount of resistance.

2. The apparatus of claim 1 wherein said chair includes a seat portion, wherein said platform includes a top surface and wherein said connecting means further includes a means to adjustably control the angle between said top surface and said seat portion.

3. The apparatus of claim 2 wherein the means to adjustably control the angle is a clevis amount structure.

4. The apparatus of claim 1 wherein said platform is in the form of an inclined plane.

5. The apparatus of claim 4 wherein said platform includes means for varying the extent of inclination of the inclined plane so formed.

6. The apparatus of claim 5 wherein said varying means varies the extent of inclination of said inclined plane substantially from between 20° to 30°.

7. The apparatus of claim 1 wherein said resistance means includes a hydraulic cylinder having a cylindrical rod attached to said chair and removable from a casing attached to said platform, and said resistance means resist under forces generated by a user in attempting to stand while constrained to said chair.

8. The apparatus of claim 1 wherein said securing means comprises means for strapping said user to a sitting position within said chair.

* * * * *